United States Patent [19]

Tusinski

[11] Patent Number: 4,521,994

[45] Date of Patent: Jun. 11, 1985

[54] POLISHER-FINER APPARATUS

[75] Inventor: Joseph Tusinski, Muskogee, Okla.

[73] Assignee: Coburn Optical Industries, Muskogee, Okla.

[21] Appl. No.: 515,409

[22] Filed: Jul. 20, 1983

[51] Int. Cl.[3] ..... B24B 7/00

[52] U.S. Cl. ..... 51/58; 51/67; 51/162

[58] Field of Search ..... 51/58, 67, 162

[56] References Cited

U.S. PATENT DOCUMENTS 3,732,647 5/1973 Stith ..... 51/54

4,320,599 3/1982 Hill et al. ..... 51/58

*Primary Examiner*—Frederick R. Schmidt

*Assistant Examiner*—J. T. Zatarga

*Attorney, Agent, or Firm*—John J. Byrne; Edward E. Dyson; Bradford E. Kile

[57] ABSTRACT

A lens polisher-finer apparatus has a frame and gimbal mounted assembly for providing an orbital break-up motion to a lens lapping tool. The apparatus includes an X-Y motion assembly connected to the frame and lens for providing smooth, Lissajous figure motions to the lens. Commonly driven first and second cams provide the motions in the X and Y directions.

16 Claims, 7 Drawing Figures

POLISHER-FINER APPARATUS

BACKGROUND OF THE INVENTION

This invention relates to an apparatus for finishing lenses. More specifically, this invention relates to an apparatus for polishing or fining spherical or toric surfaces of ophthalmic lenses. In ophthalmic lens finishing, the term "polish" or "fine" are terms of art indicating a degree of finish achieved. Since the subject apparatus is used for both polishing and fining the terms will be used interchangeably.

In the manufacture and finishing of ophthalmic lenses, lens blanks are first formed from glass or a plastic composition such as polymethylmethacrylate and a convex surface of the lens is mounted upon a retaining member known as a lens block. The lens and block are then accurately mounted upon a grinding apparatus wherein either a spherical surface or a toroidal surface of compound prescriptive value is rough-ground into a concave portion of the lens. (In toroidal lens a first principle meridian of the lens typically has a different dimension than a second principle meridian normal to the first.) Following the initial grinding operation, an ophthalmic lens is fined and then polished to a final prescriptive value. Left and right lenses are then mounted upon an edge grinding machine to cut the outer peripheral shape required to be compatible with an ultimate wearer's eyeglass frame.

The subject invention is directed to a polisher-finer apparatus and comprises an improvement over a Stith U.S. Pat. No. 3,732,647 of common assignment with the subject application. The Stith patent discloses a polisher-finer wherein lenses are finished by being biased into engagement with a lapping tool having a spherical or toric surface of a final desired prescription. The lapping tool is driven in an orbital, break-up motion relative to the lens to prevent ridges, grooves, and/or other aberrations from forming in the lens surface which might occur if regular or uniform motion devices were utilized. In addition to orbital break-up motion of the lapping tool, the Stith patent discloses moving the lens in a transverse motion from side-to-side.

Another advantageous form of polisher-finer apparatus is disclosed in a Hill et al. U.S. Pat. No. 4,320,599, again assigned to the assignee of the subject application. In the Hill et al. patent first and second assemblies are provided for carrying a lapping tool and lens, respectively, imparting an orbital break-up motion during a fining and polishing operation. The amplitude of orbital motion is variable in the Hill et al. structure by application of a novel cam assembly to adjust the degree of orbital break-up motion of the lens mounting and/or lapping tool.

In at least one other system, a lens polishing apparatus is disclosed wherein a lapping tool is driven through a gimbal assembly while a lens to be polished is mounted upon a unit which provides linear transverse motion and simultaneous front-to-rear motion during a polishing operation. Such linear motion, however, is operated by a two-position cam operated fluid (air) switch. Such actuation tends to produce a saw-tooth aberration on the lens surface to a degree which is not acceptable in many applications.

Although polisher-finer systems of the type previously described have been widely utilized, room for significant improvement remains. In this regard it would be desirable to decrease the speed and amplitude of motion of a lens lapping tool for enhanced control, while concomitantly maintaining the feet-per-minute of relative motion between a lens and tool to facilitate rapid polishing and fining. It would also be desirable to provide a system for achieving a novel motion to a lens in an X-Y plane which would eliminate any tendency for the creation of a saw-tooth aberrations on the lens. If this could be achieved the rate of finishing of an ophthalmic lens could be increased without sacrificing any of the system finishing quality.

OBJECTS OF THE INVENTION

It is therefore a general object of the invention to provide a novel apparatus for finishing ophthalmic lenses which will obviate disadvantages and advantageously achieve desirable characteristics of the type previously described.

It is a particular object of the invention to provide an apparatus for enhancing the speed in which toric and spheric lens surfaces may be fined and polished.

It is a related object of the invention to provide a polisher-finer apparatus wherein the lens may be simultaneously moved in both an X and a Y direction without producing saw-tooth aberrations on the lens surface.

It is another object of the invention to provide a polisher-finer apparatus wherein a smooth, X-Y pattern of movement of the lens may be achieved and the pattern and degree of movement of the lens may be advantageously altered and/or adjusted as desirable.

It is a further object of the invention to provide a novel polisher-finer apparatus wherein the speed and relative finishing motion between a lens-lapping tool and a lens may be enhanced.

BRIEF SUMMARY OF THE INVENTION

A preferred embodiment of the invention comprises a lens polisher-finer apparatus having a frame and a gimbal mounted assembly for providing an orbital break-up motion to a lens lapping tool. The subject polisher-finer apparatus further includes an X-Y motion assembly connected to the frame and lens for providing smooth, Lissajous figure motions to the lens. The X-Y supporting assembly is reciprocally driven by a first cam which operably drives the lens in an X direction and a second cam which simultaneously drives the lens in a Y direction. The first and second cams are commonly driven and the amplitude of the X and Y motion and relative frequency may be selectively varied by the mechanical drive system.

THE DRAWINGS

Other objects and advantages of the present invention will become apparent from the following detailed description of a preferred embodiment thereof taken in conjunction with the accompanying drawings, wherein.

Figure 5:
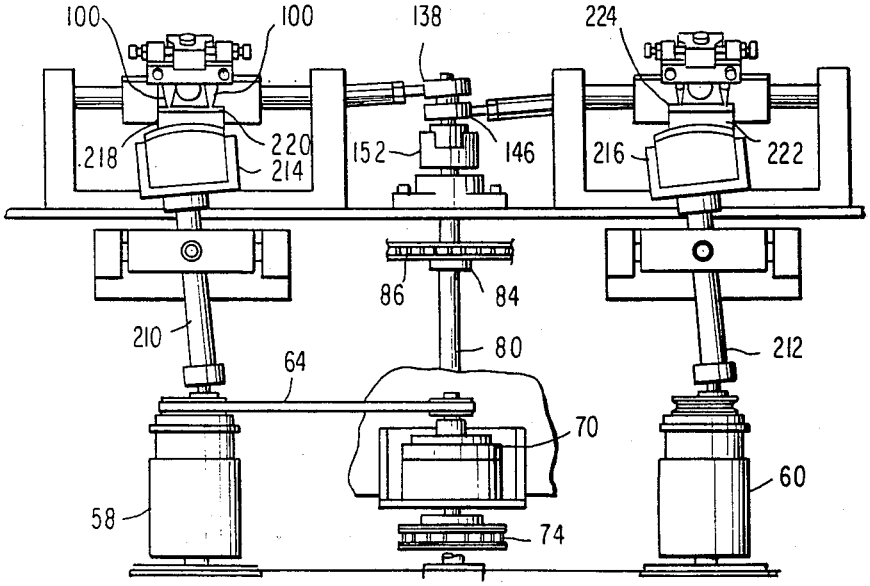
Figure 6:
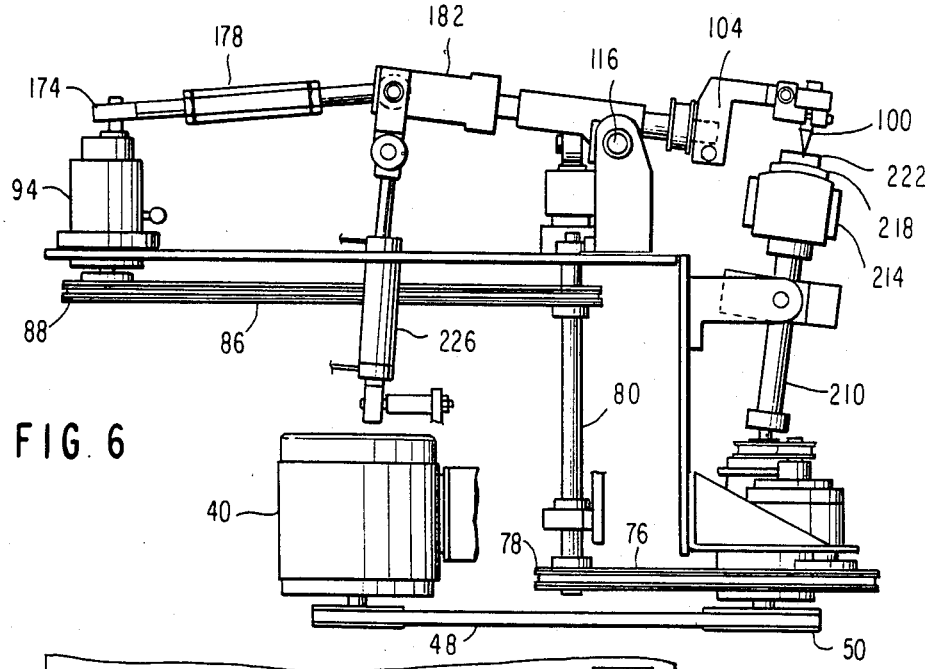

FIG. 5, note sheet one, is a front view of the subject apparatus which discloses a lower gimbal-mounted, break-up assembly for driving a lapping tool and an upper lens X-Y motion drive;

FIG. 6 is a side elevational view of the subject apparatus; and

Figure 7:
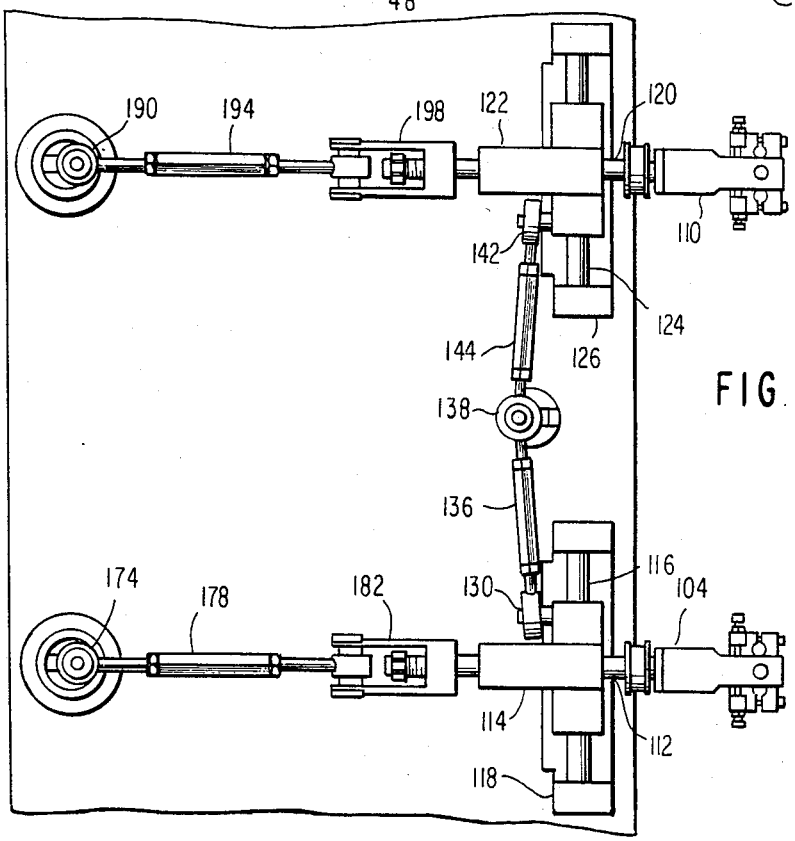

FIG. 7 is a plan view of the X-Y motion drive in accordance with the invention.

DETAILED DESCRIPTION

Figure 1:
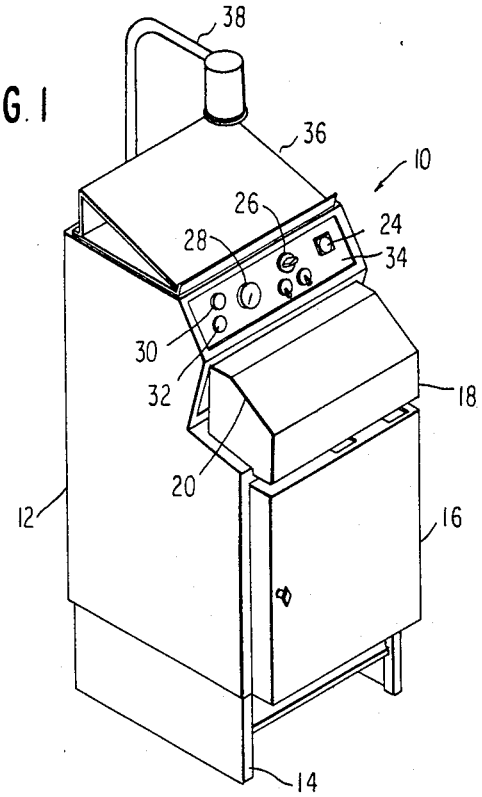
FIG. 1 is an axonometric view of an apparatus for polishing and fining ophthalmic lenses in accordance with a preferred embodiment of the invention.

Referring now to the drawing, wherein like numerals indicate like parts, and particularly FIG. 1 thereof, there will be seen an axonometric view of a polisher-finer apparatus 10 in accordance with a preferred embodiment of the invention.

Before providing a detailed description of the polisher-finer lens and lapping tool drive system, it may be worthwhile to briefly outline an operative context of the instant invention. In this connection, the polisher-finer apparatus 10 includes a generally upright cabinet 12 which is supported upon a cabinet base 14. The cabinet 12 includes a front door 16 which is positioned beneath a slurry bowl 18 having a door 20 which provides access into the bowl for polishing and fining a lens.

The polisher-finer is provided with a closed loop fluid system, an air pressure system, and an electrical system (not shown). These systems are controlled and monitored by an array of gauges and control switches such as a timer 24, a main switch 26, a gauge 28, a cycle light 30, a regulator 32, etc. mounted upon a control panel 34.

Finally, a work tray 36 is positioned on top of the cabinet 12 and a working lamp 38 illuminates the apparatus as desired.

In brief operation an operator desiring to finish ophthalmic lenses lifts the cover 20 and inserts the appropriate lapping tools within the interior of the slurry bowl 18. The lapping tools are selected to have a spherical or convex toric configuration compatible with the shape of the lens to be finished.

Left and right blocked lenses are then positioned upon the lapping surface of the tools and are biased against the tools by the provision of an air pressure biasing assembly.

Lens finishing (i.e., polishing and/or fining) is then achieved by providing an orbital break-up motion with the lapping tools and a simultaneous X-Y motion of the lenses. The working surfaces of the tools and also the surfaces of the lenses are continuously drenched within the slurry bowl 18 with a fine abrasive fluid from a closed loop fluidic system as previously mentioned.

Common Drive System

Figure 3:
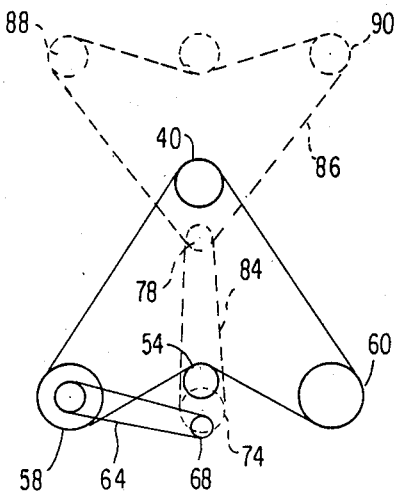
FIG. 3 is a schematic plan view of the drive system disclosed in FIG. 2.
Figure 2:
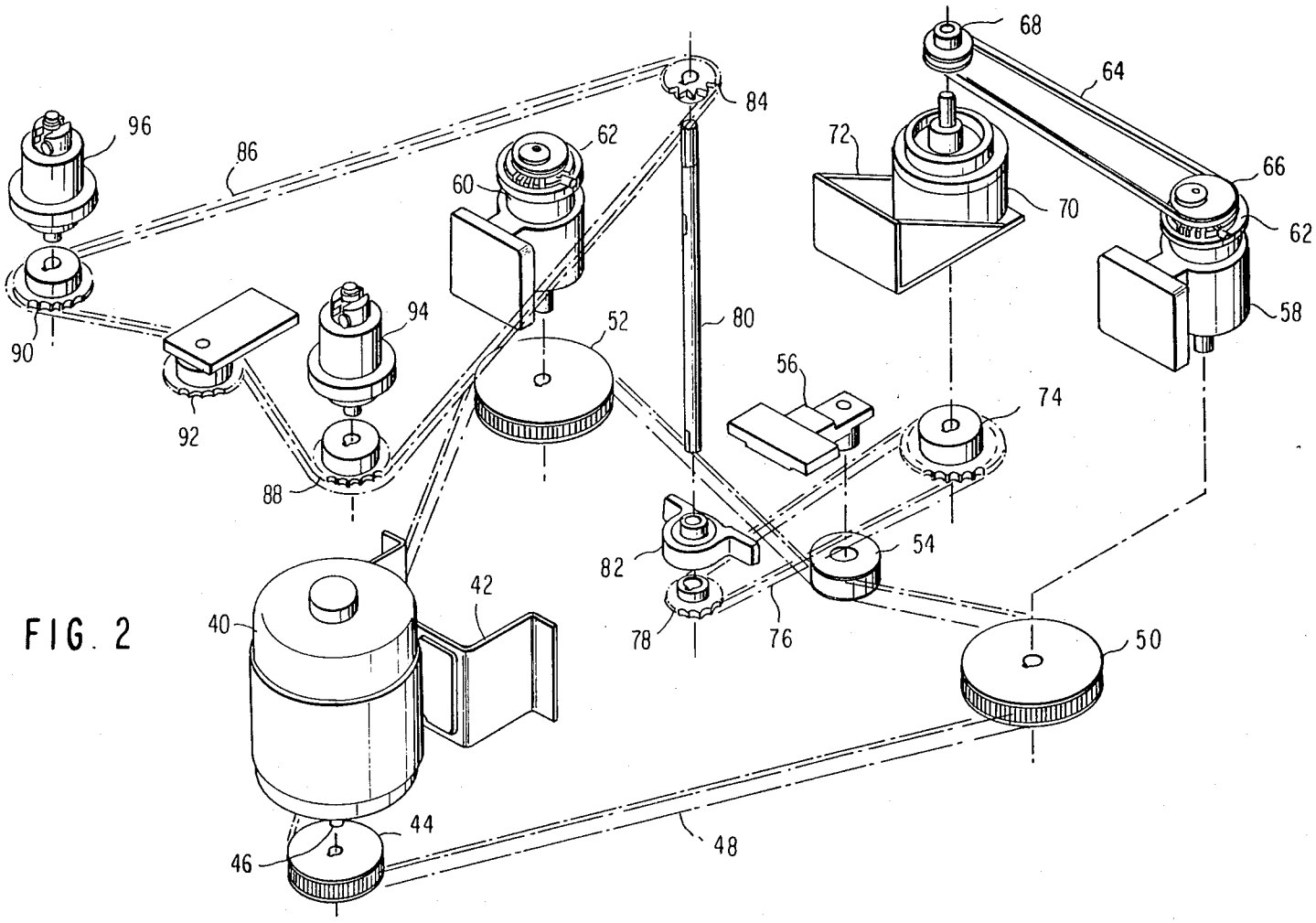
FIG. 2 is an axonometric view of an assemblage of principal components comprising a drive system of the subject invention.

Referring now particularly to FIGS. 2 and 3 there will be seen views of a common drive system for providing orbital, break-up motion of the finishing tools and simultaneous X-Y motion to the lenses biased against an upper surface of the lapping tools.

Drive for the system is provided by a system drive motor 40 which may be, for example, a one-half horsepower electric motor. The motor is mounted within the interior of the cabinet 12 by a U-shaped mounting bracket or base 42. A motor pully 44 is keyed to a drive shaft 46 of the motor and a continuous timing belt 48 extends from the motor pully around a first timing pully 50, a second timing pully 52 and back to the motor pully 44. An idler pully 54 is mounted upon an idler bracket 56 which is connected within the interior of the cabinet 12 and is positioned intermediate the timing pullys 50 and 52 to maintain tension on the timing belt.

A first orbital drive assembly 58 is keyed to the timing pully 50 and a second identical orbital drive assembly 60 is keyed to timing pully 52. The orbital drive units 58 and 60 may be provided with an amplitude adjustment mechanism 62 such as disclosed and claimed in the previously identified Hill et al. U.S. Pat. No. 4,320,599. The disclosure of this Hill et al. patent is hereby incorporated by reference as though set forth at length. Briefly, however, the purpose of the orbital drive assembly is to provide an orbital, break-up drive for lapping tools which serves to fine and polish lenses.

An X-Y motion drive in accordance with the instant invention is driven by the electric motor 40 and in this connection a V-belt 64 is trained around a pully 66 mounted upon the orbital drive assembly 58 and serves to rotate a gear box pully 68. The pully 68 is keyed in turn to a gear box 70 which is mounted within a frame 72 positioned within the interior of cabinet 12. The gear box 70 serves to drive a gear box sprocket 74 which is linked by a continuous chain 76 to a drive shaft sprocket 78. A drive shaft 80 is journalled through a pillow block bearing 82 and carries a drive shaft sprocket 84 which is linked via an endless chain 86 to a first Y motion sprocket 88 and a second Y motion sprocket 90. An idler sprocket 92 positioned between Y motion sprockets 88 and 90 serves to maintain tension on the endless chain 86 in a manner well known in the art.

The Y motion sprocket 88 is keyed to a first Y motion spindle assembly 94 and in a similar manner the Y motion sprocket 90 is keyed to a second Y motion spindle assembly 96. Each of the spindle assemblies 94 and 96 includes a spindle shaft and a Y motion cam which will be discussed in detail hereinafter.

In addition to driving the Y motion spindles 94 and 96, the drive shaft 80 extends through sprocket 84 and is connected directly into an X motion cam, note FIG. 4, which will be discussed below.

Referring now to FIG. 3, note again sheet 1, a plan view of a schematic arrangement of the previously discussed drive system is disclosed. In this connection the single electric motor 40 drives orbital drive assemblies 58 and 60. A V-belt 64 connects a pully mounted upon the spindle 58 to a gear box pully 68 which in turn drives a chain sprocket 74 and a drive shft sprocket 78 via endless chain 76. The drive shaft sprocket 78, in turn, directly drives an X motion cam mounted upon drive shaft 80 coaxially positioned above the drive sprocket 78. This same drive shaft 80 in cooperation with a drive shaft sprocket 84 simultaneously drives a first Y motion sprocket 88 and a second Y motion sprocket 90 via an endless chain 86.

Figure 4:
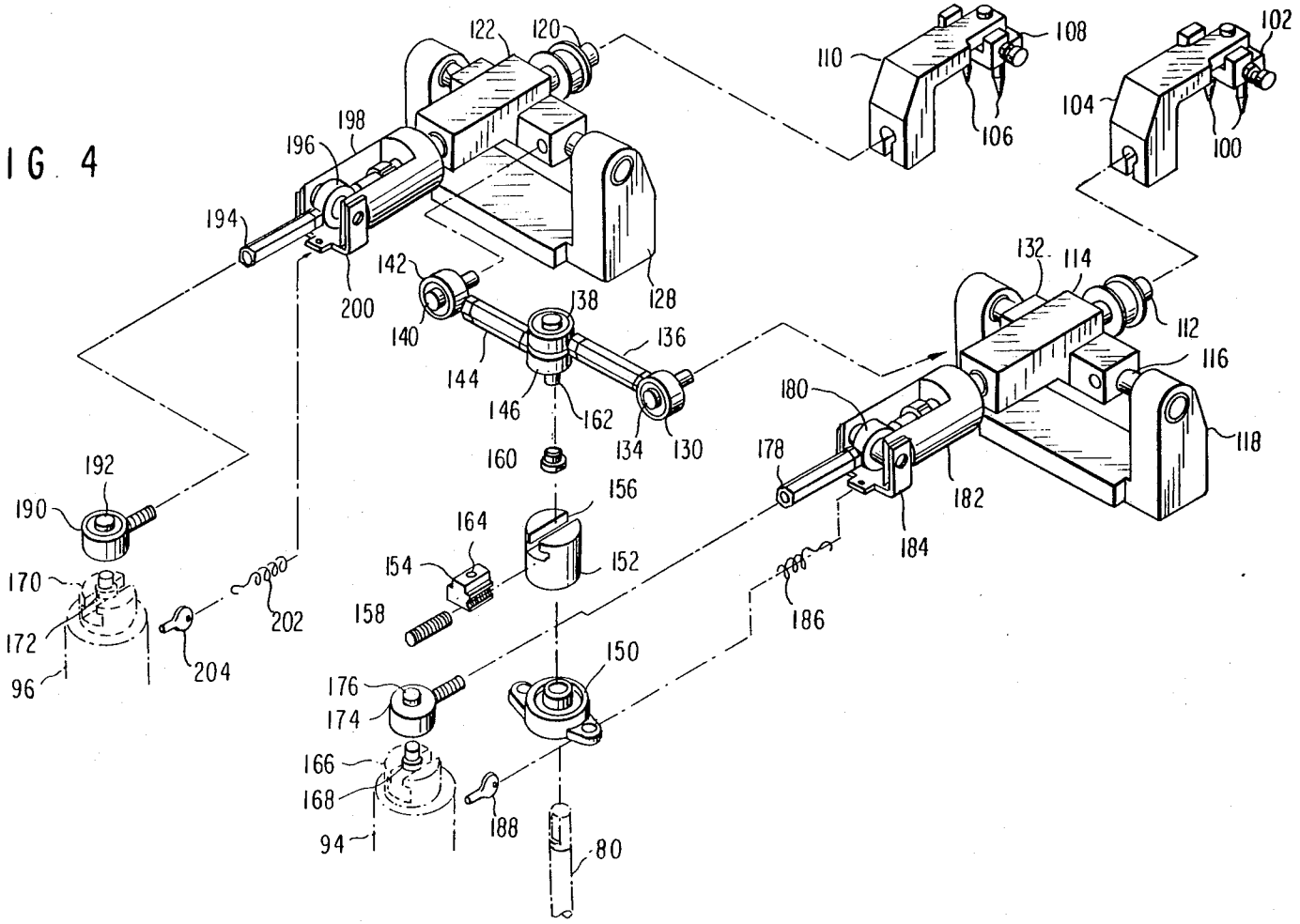
FIG. 4 is an axonometric view of an assemblage of principal components of an X and Y motion drive in accordance with the invention.

Turning now to FIG. 4 there will be seen a schematic representation of an X-Y motion assembly in accordance with a preferred embodiment of the invention. More particularly a first pair of polishing pins 100 of the type intended to cooperate and engage with receiving depressions within the back surface of a lens block are shown mounted within a pin holder 102 which in turn is adjustably supported by a rocker arm 104. A second set of polishing pins 106 are mounted within a similar pin holder 108 and rocker arm 110.

The first rocker arm 104 is operatively connected to a pin holder shaft 112 which is mounted for axial translation in a Y direction through a rocker arm holder 114. The rocker arm holder 114, in turn, is mounted for X direction translation upon a rocker arm 116 mounted upon a generally U-shaped, oscillation bracket 118 within the polisher-finer cabinet.

In an identical manner a second rocker arm 110 is fitted onto a pin holder shaft 120 which is mounted for Y motion translation through a rocker arm holder 122. The rocker arm holder, in turn, is mounted for X direction translation upon a rocker arm 124 mounted between the upright arms of an oscillation bracket 126.

An X motion reciprocating assembly 128 is mounted between rocker arm holder 114 and 122 as schematically shown. In this connection a rod-end bearing 130 is joined to an inside leg 132 of the rocker arm holder 114 by a socket cap screw 134. The rod-end bearing 130 is connected via an X motion link 136 to another rod-end bearing 138 which is rotated 90° with respect to the first rod-end bearing 130. In a similar manner, the rocker arm holder 122 is connected via a socket cap-screw 140 to an outer rod-end bearing 142 which is connected by an X motion link 144 to another rod-end bearing 146. Bearing 146 is rotated 90° with respect to rod-end bearing 142 and coaxially positioned with respect with end bearing 138.

The drive shaft 80, as previously mentioned in connection with FIG. 2, extends through an upper bearing 150 and is axially mounted within an X motion cam body 152. A slide block 154 is operably received within a channel 156 cut through the upper portion of the cam body 152 and is held in position by a motion adjustment screw 158. A cam position indicator 160 is fitted within the slot 156 and receives a socket cap screw 162 which extends through rod-end bearings 138 and 146 of the X motion links and is threaded into a compatibly thread bore 164 formed within the cam slide block 154. Accordingly, when the slide block 154 is positioned within channel 156 such that bore 164 is offset with respect to the axis of cam body 152 and drive shaft 80, the rod-end bearings 138 and 146 will exhibit a circular motion in response to rotation of drive shaft 80. Circular motion of the rod-end bearings 138 and 146, in turn, will produce a reciprocation in an X direction of the rocker arm holders 114 and 122, which directly translate the lens polishing pins 100 and 106 in an X direction.

In addition to reciprocation of the pins 100 and 106 in an X direction, the subject invention provides for simultaneous motion of the pins in a Y direction. Y motion drive, in accordance with a preferred embodiment of the invention, is provided by a first Y motion spindle block 94 and a second Y motion spindle block 96 as previously discussed. An adjustable cam assembly 166 is mounted upon the upper end of the Y motion spindle assembly 94 and includes a slide block 168 identical with slide block 154. In a similar manner, a Y motion cam 170 is mounted upon Y motion spindle assembly 96 and includes a slide block 172 which is also identical with slide block 154. A Y motion rod-end bearing 174 is connected to the slide block 168 via a socket head cap-screw 176 which in turn is connected by a Y motion link 178 to another rod-end bearing 180 mounted within a Y motion adapter 182. A spring bracket 184 is connected to an outward end of Y motion adapter 182 and a spring 186 is connected between the bracket 184 and a key 188 connected to a polisher-finer frame. In an identical manner a rod-end bearing 190 is mounted by a sprocket head cap-screw 192 to the slide block 172 and is connected by a Y motion link 194 to another end bearing 196 mounted between the arms of a Y motion adapter 198. A spring bracket 200 is connected to the Y motion adapter and a spring 202 is mounted by a key 204 to the polisher-finer frame. The springs 186 and 202 serve to take up slack and facilitate a smooth operation of the system.

Briefly returning to FIG. 2, it will be seen that the endless chain 86 operably serves to directly connect the drive shaft 80 to the Y motion spindles 94 and 96 which, in turn, serve to translate the pin holder shafts 112 and 120 in a reciprocating Y direction as the cams 166 and 170 are rotated.

Motion of the pins reciprocally in an X direction is generally in the form of a sine wave. In a similar manner motion of the pins in a Y direction is also in the form of a sine wave. The X and the Y motion amplitude is controlled by the position of the slide blocks 154, 168, and 172 while the frequency is determined by the speed of rotation of shaft 80 and the relationship of the number of teeth on sprocket 84 with respect to the teeth on sprockets 88 and 90. The resulting interposition of two sinusoidal waves mechanically produces a resulting Lissajous figure motion to the polishing pins 100 and 106. In this connection, if two sinusoidal motions of equal magnitude but out of phase by 90°, the resultant Lissajous motion would be in the form of a circle. If the X motion has a fixed frequency and an adjustable amplitude and the Y motion has a frequency approximately one-half of the X motion frequency and an amplitude approximately adjustable to one-half of X, the resultant is a flat, figure-eight pattern that degenerates into somewhat of a separated U-pattern, and then back to a figure-eight pattern, as is well-known with Lissajous figures. The rate of change is based on how close the frequency is related to the reference. The closer the Y rate is to one-half of the X rate, the slower the transition takes place. If the Y rate is exactly equal to the X rate and 90° out of phase, a resulting stationary Lissajous figure-eight pattern would exist. However, in a preferred embodiment the Y rate is selected not to be exactly equal to one-half of the X rate, and accordingly, the Lissajous pattern continually varies in a smooth but constant transition.

Referring now to FIG. 5, note sheet 1, and FIGS. 6 and 7, note sheet 4, there will be seen a physical assembly of the common orbital drive and X-Y motion assemblies previously described, operable to be mounted within the polisher-finer cabinet. More specifically, the motor 40, best seen in FIG. 6, drives timing pulleys 50 and 52 (not shown) via the timing belt 48. These pullys in turn rotate orbital drive assemblies 58 and 60 which are connected to gimbal-mounted shafts 210 and 212. A tool holder 214 is mounted at the distal end of shaft 210 and a similar tool holder 216 is mounted on top of shaft 212. A left lens 218, mounted upon a carrying block 220 is fitted on top of tool 214 and a right lens 222 mounted upon a working block 224 is placed on top of tool 216. Pin assemblies 100 are then lowered into contact with the upper surface of lens block 220 by actuation of an air cylinder 226, note FIG. 6, which pivots the Y motion adapter 182 upward about rocker arm shaft 116. The lapping tools 214 and 216 exhibit an orbital break-up motion in a manner as previously set forth in connection with the above-identified Hill et al. patent.

The V-belt 64 serves to drive a gear box 70 rotating sprocket 74 and drive shaft 80 via an endless chain 76. The drive shaft 80 is splined to sprocket 84 and extends into X motion cam 152, note FIG. 5. The X motion cam, as previously indicated, serves to reciprocate the lens pins in an X direction via X motion links 136 and 144, note FIG. 7. Simultaneously, an endless chain 86 mounted about sprocket 84, drives sprockets 88 and 90 thus in synchronism with the X motion drive to reciprocate the pins in a Y direction through connecting links 178 and 194. The resulting Lissajous pattern of movement of the lens can be advantageously varied in amplitude by the position of the slide blocks 154, 168, and 172 within a respective cam spindle. The frequency may be varied by selection of the number of teeth within the chain sprockets 84, 88, and 90.

Advantages of the Invention

After reviewing the foregoing description of a preferred embodiment of the invention, in conjunction with the drawings, it will be appreciated by those skilled in the art that several distinct advantages of the subject polisher-finer apparatus are obtained.

Without attempting to set forth all of the desirable features of the instant invention, at least some of the major advantages include the provision of a unique combination of an orbital, break-up motion for a lapping tool in cooperation with a Lissajous pattern movement of a lens to be finished. The pattern of the Lissajous motion may be advantageously selected and varied in amplitude and frequency to produce a gradually varying, non-repeating pattern and thus eliminate aberrations in the lens surface.

The combination of a Lissajous motion and orbital break-up motion cooperate to maintain the polishing speed in terms of the relative feet-per-minute of motion between the lens and lapping tool, while reducing the effective motion of the lapping tool to thus provide enhanced control of the finishing operation.

In describing the invention, reference has been made to a preferred embodiment. Those skilled in the art, however, and familiar with the disclosure of the subject invention, may recognize additions, deletions, modifications, substitutions, and/or other changes which will fall within the purview of the subject claims.

I claim:

1. An apparatus for finishing a surface of a lens comprising;

a frame;

means connected to said frame for providing an orbital, break-up motion to a tool having a polishing surface of a selected base curve and cross curve; and means connected to said frame for providing a smooth, continuous Lissajous figure motion to a lens of generally common base curve and cross curve with the tool, said means including, means connected to said frame for mechanically supporting the lens for reciprocation in an X direction and simultaneous reciprocation in an Y direction;

means connected to said frame for driving said supporting means in an X direction of reciprocation, said means including a first cam means operably connected to said means for supporting and means for rotating said first cam; and means connected to said frame for driving said means for supporting in a Y direction of reciprocation, said means including a second cam means and means for rotating said second cam means wherein simultaneous rotation of first cam means and second cam means produce simultaneous X movement and Y movement of the lens with respect to the tool with a generally smooth Lissajous figure.

2. An apparatus for finishing a surface of a lens as defined in claim 1 and further comprising;

means operably connected to said support means for selectively varying the amplitude of the X direction reciprocation of said supporting means.

3. An apparatus for finishing a surface of a lens as defined in claims 1 or 2 and further comprising:

means for selectively varying the amplitude of Y direction reciprocation of said supporting means.

4. An apparatus for finishing a surface of a lens as defined in claim 3 wherein;

said first and second cam means are driven by a common mechanical drive system.

5. An apparatus for finishing a surface of a lens as defined in claim 4 wherein:

said common mechanical drive comprises;

a continuous drive chain;

said means for rotating said first cam comprises a first chain sprocket means operably connected to said first cam means; and said means for rotating said second cam means comprises a second chain sprocket means operably connected to said second cam.

6. An apparatus for finishing a surface of a lens as defined in claim 5 wherein;

a number of teeth in said first sprocket means is different from the number of teeth in said second sprocket means whereby the Lissajous figure motion constantly varies.

7. An apparatus for finishing a surface of a lens as defined in claim 6 wherein;

the number of teeth in said first sprocket means is less than the number of teeth in said second sprocket means.

8. An apparatus for finishing a surface of a lens as defined in claim 3 wherein said means for varying the amplitude of the Y direction reciprocation of said supporting means includes;

a cam shaft and head having a diametrical slot and a slide block positioned within the diametrical slot of said head and means for securing said slide block at selected locations within said slot for varying the amplitude of the Y direction reciprocation of said means for supporting said lens.

9. An apparatus for finishing a surface of a lens as defined in claim 2 wherein said means for varying the amplitude of the X direction reciprocation of said supporting means includes comprising:

a cam shaft and head having a diametrical slot and a slide block positioned within the diametrical slot of said head and means for securing said slide block at selected locations within said slot for varying the amplitude of the X direction reciprocation of said means for supporting said lens.

10. An apparatus for finishing a surface of a lens comprising:

a frame;

means connected to said frame for providing an orbital, break-up motion to a tool having a polishing surface of a selected base curve and cross curve; and means connected to said frame for providing a smooth Lissajous figure motion to a lens of generally common base curve and cross curve with the tool, said means including, means connected to said frame for mechanically supporting the lens for reciprocation in an X direction and simultaneous reciprocation in a Y direction, means connected to said frame for driving said supporting means in an X direction of reciprocation, said means for driving including a first cam means operably connected to said means for supporting;

means connected to said frame for driving said means for supporting in a Y direction of reciprocation, said means for driving including a second cam means and means for rotating said second cam means; and said means for rotating said first cam means and said means for rotating said second cam means comprises a common mechanical drive wherein simultaneous rotation of said first cam means and said second cam means produce simultaneous X movement and Y movement of the lens with respect to the tool in a generally smooth Lissajous figure motion.

11. An apparatus for finishing a surface of a lens as defined in claim 10 wherein said common mechanical drive includes;

a common chain and a first sprocket means connected to first cam means and second sprocket means connected to said second cam means.

12. An apparatus for finishing a surface of a lens as defined in claim 11 wherein;

the number of teeth in said first sprocket means is different from the number of teeth in said second sprocket means whereby the Lissajous figure motion constantly varies.

13. An apparatus for finishing a surface of a lens as defined in claim 12 wherein;

the number of teeth in said first sprocket means is less than the number of teeth in said second sprocket means.

14. An apparatus for finishing a surface of a lens as defined in claim 12 and further comprising;

means for varying the amplitude of X direction reciprocation of said means for supporting said lens.

15. An apparatus for finishing a surface of a lens as defined in claim 12 and further comprising;

means for varying the amplitude of the Y direction reciprocation of said means for supporting said lens.

16. An apparatus for finishing a surface of a lens as defined in claim 12 and further comprising;

means for varying the amplitude of X direction reciprocation of said means for supporting said lens; and means for varying the amplitude of the Y direction reciprocation of said means for supporting said lens.

* * * * *